United States Patent [19]

Janssen et al.

[11] Patent Number: 4,864,753

[45] Date of Patent: Sep. 12, 1989

[54] LARGE FRAME VISIBLE INDEX SYSTEM

[76] Inventors: Alexander P. Janssen, 28 Old Farm Rd., Charlottesville, Va. 22901; Samuel A. Loyd, Jr., Rt. 4, P.O. Box 16, Waynesboro, Va. 22980

[21] Appl. No.: 127,659

[22] Filed: Dec. 2, 1987

Related U.S. Application Data

[63] Continuation of Ser. No. 764,760, Aug. 12, 1985, abandoned.

[51] Int. Cl.[4] ..... G09F 19/00

[52] U.S. Cl. ..... 40/535; 40/530; 40/359

[58] Field of Search ..... 40/359, 360, 535, 536

[56] References Cited

U.S. PATENT DOCUMENTS

| | | | |
|---|---|---|---|
| 222,033 | 11/1879 | Glover | 40/530 |
| 243,772 | 7/1881 | Glover | 40/536 |
| 517,123 | 3/1894 | Nash | 40/535 |
| 637,641 | 11/1899 | Moore | 40/530 |
| 699,871 | 5/1902 | Johansson | 40/535 |
| 1,050,742 | 1/1913 | Manson . | |
| 1,777,438 | 10/1930 | Johnson | 40/536 |
| 1,838,276 | 12/1931 | Miller | 40/535 |
| 2,042,656 | 6/1936 | Hake | 40/535 |
| 2,217,018 | 1/1939 | Hopkins . | |
| 2,537,268 | 1/1951 | Hall . | |
| 2,650,594 | 11/1950 | Heilman . | |
| 2,975,537 | 3/1961 | Reid et al. . | |
| 3,274,715 | 9/1966 | Janssen . | |
| 4,270,290 | 6/1981 | Eckert | 40/535 |

*Primary Examiner*—Gene Mancene
*Assistant Examiner*—Wenceslao J. Contreras
*Attorney, Agent, or Firm*—Hughes & Multer

[57] ABSTRACT

Visible index systems which include a support and hanger wires for detachably affixing cards and pocket cards to the support in an overlapping arrangement. The arrangement for fixing the hanger wires to the support is so constructed that each card or pocket card is independently supported, and lateral movement of the hanger wires is precluded as is lateral movement of the cards along those wires.

16 Claims, 5 Drawing Sheets

LARGE FRAME VISIBLE INDEX SYSTEM

CROSS REFERENCE TO RELATED APPLICATION

This application is a continuation of copending application No. 764,760 filed Aug. 12, 1985, by Janssen et al. for LARGE FRAME VISIBLE INDEX SYSTEM (now abandoned).

BACKGROUND OF THE INVENTION

This invention relates to visible index systems and more particularly relates to large frame visible index record systems wherein a plurality of record cards or card holders are pivotally mounted on a frame or tray in an overlapped edgewise spaced arrangement.

Visible index systems of this general type are described, for example, in U.S. Pat. No. 2,975,537 to Reid et al. and U.S. Pat. No. 2,217,018 to Hopkins. The Reid et al. patent illustrates a visible index system utilizing record cards. The Hopkins patent illustrates a visible index system using pocket card holders upon which a record card or cards may be removably mounted. Visible index systems of this type are applicable to virtually any record keeping function and provide the convenience of high visibility and ready removability. Metal hinges on the cards or card pockets are pivotally mounted on resilient spring steel hangers. The hangers have ends which spring into side channels of the type shown in the Reid et al. patent mentioned above or other suitable retainers. for the hanger ends. With the Reid et al. type of arrangement the cards or card holders are slidable in the mounting tray.

U.S. Pat. No. 2,537,268 to Hall and U.S. Pat. No. 3,274,715 to Janssen illustrate a modified mounting system wherein the wire hangers are received in separate notches in the frame or tray for non-slidable mounting.

Another version of the non-slidable mounting of wire hangers in a panel or tray is illustrated by way of example in U.S. Pat. No. 2,650,594 to Heilman. According to the arrangement disclosed in that patent, a tray intended for vertical mounting is provided with a series of upwardly extending tongues struck from the tray. Mounting rods are dropped or snapped into the openings between the upper ends of the tongues and the wall of the tray. By virtue of the particular mode of mounting, it is not necessary that the rods be resilient.

The use of visible index systems in hospital type applications is well known. Another application of visible index systems is in connection with machinery maintenance where such systems may be used to record, preserve and present such information as maintenance inspections schedules, history of repair, equipment records and the like information. In certain situations, such as with the maintenance and repair of automotive vehicles and aircraft, the recorded information is of such a nature that relatively large capacity visible index systems are desirable.

In such instances, it has been common practice to merely multiply the size of the tray and the number of cards and card holders. For example, visible index systems are available which utilize multiple columns of display cards on a large single frame or tray. Thus, a single large tray may contain as many as 5 columns of display cards and each column may contain as many as 100 cards. According to present practices, such large card holdres are carried by multiple wire hangers attached to the top edge thereof by a pair of hinges for each wire hanger. It is not unusual to use an array containing 100 card holders attached to 500 separate wire hangers. While such systems are satisfactory in a general sense, the manufacturing assembly of a system containing such a large number of hangers is time consuming and costly in a relative sense. In addition, the maintenance of such systems poses problems.

SUMMARY OF THE INVENTION

It is a feature of the present invention that the same large volume of information may be maintained in a visible card index system utilizing a fraction of the number of wire hangers which were previously deemed to be necessary. As a result, the manufacturing assembly time and cost may be significantly reduced.

It is a primary object of the invention to provide a visible index system for cards or pocket cards having an improved means of mounting the cards or pocket cards to the frame or tray by means of flexible wire hangers.

It is another object of the invention to provide an improved visible card index system for presenting a large volume of information and number of index cards mounted on resilient wire card hangers in such a manner as to permit the usage of a significantly lesser number of hangers than previously required to handle the same volume of information and number of display cards.

It is another object of the present invention to provide a novel improved visible index system for pocket cards having resilient wire hanges which are received in individual mounting means which peripherally surround the hanger portion received therein.

It is another object of the invention to provide an improved visible index system for cards or pocket cards hingedly mounted to a support or tray by means of mounting means substantially entirely peripherally surrounding the hanger and providing not only pivotal securement but also lateral restraint for the cards or pocket cards hingedly mounted therein.

It is another object of the invention to provide an improved visible index system for cards or pocket cards of large size including an improved mounting means for hingedly attaching the card or pocket card to the mounting panel or tray through the use of a resilient wire hanger and mounting means which substantially completely surround the wire hanger at a multiplicity of positions along the length of the wire hanger including locations intermediate the ends thereof.

It is another object of the invention to provide an improved visible index system of the type wherein cards or pocket cards are hingedly mounted to a support panel or tray including improved mounting means comprising hanger holders struck from the tray and substantially completely peripherally surrounding the hanger at spaced positions.

It is another object of the invention to provide a visible card index system for hingedly mounting a plurality of card means on a frame using a multiplicity of resilient wire hangers disposed in spaced parallel relationship and each supporting a pair of hinges attached to an edge of a car means with the wire hangers extending through each of the pair of hinges and having spaced end sections extending beyond the hinges, the frame means having attached thereto a pair of spaced intermediate mounting means disposed in substantially parallel relationship on axes substantially perpendicular to the axes of the wire hangers with each hanger passing through a pair of such spaced intermediate mounting means, the mounting means providing substantially complete peripheral containment of the hangers, the frame means also including a pair of spaced end mounting means disposed in substantial parallel relationship to said intermediate mounting means with the end mounting means receiving the end sections of the hangers, and the hangers being capable of flexure to permit axial insertion into and removal from the end mounting means.

It is another object of the invention to provide a visible card index system of the foregoing type wherein the hinges are disposed adjacent the intermediate mounting means to limit lateral movement of the cards or card holders attached to the hinges and the end mounting means include means for abutting the end sections of the hangers received therein to limit lateral movement of the hangers.

These and further objects and advantages of the invention will become apparent from the following specification and claims and appended drawings.

DETAILED DESCRIPTION OF THE INVENTION

Figure 1:
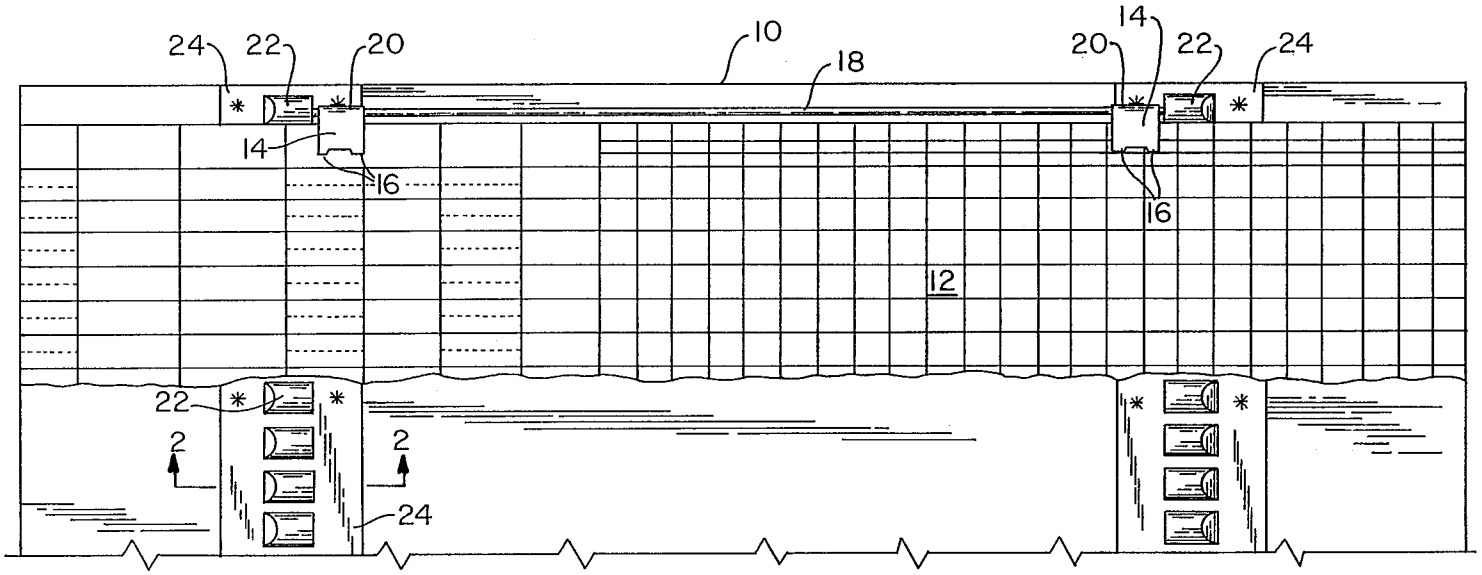
FIG. 1 is a partially broken away plan view showing a visible index system according to one embodiment of the invention.

Referring to FIG. 1, there is shown a visible index system comprising a mounting panel, frame or tray 10 carrying a relatively large index card 12. The tray illustrated is formed of metal but may be formed of any suitable material. It will be understood that while only a single index card is shown a plurality of cards will ordinarily be mounted in overlapping relationship. It will also be understood that while a card is illustrated a pocket card may also be used. The card 12 has conventional hinges 14 attached to the upper edge thereof and secured by reverse bent lugs 6. A resilient wire hanger 18 extends through the barrels 20 of the hinges 14.

The ends of the wire hanger 18 are received in dimples 22 which are struck from a pair of generally parallel metal strips 24 which may be fastened to the tray 10 in any suitable manner such as by spot welding. As shown in FIG. 1, the mounting strips 24 are spaced by a distance less the width of the card 12. This permits placement of the hinges inward of the outer edges of the card to provide optimum card support according to this particular embodiment of the invention.

Figure 2:
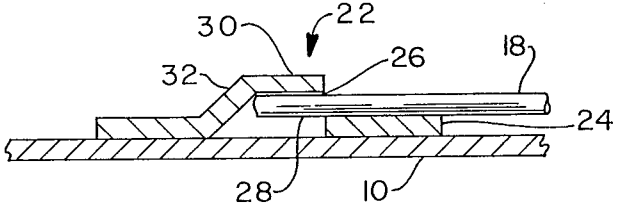
FIG. 2 is a partial vertical section through the mounting frame or tray of FIG. 1 along the line 2—2 showing details of a wire hanger securing dimple.

Referring to FIG. 2, it will be seen that the dimple indicated generally at 22 is struck from the strip 24 to provide a generally semicircular receptacle 26 which has a curvate top wall 30 and a generally quadrispherical end 32. The dimples 22 secure the wire hangers against movement (radial to the longitudinal axis of the hanger) as well as against lateral movement along the axis. The mounting means provides complete perpheral containment of the hanger ends received therein.

The index cards 12 may be attached to the tray 10 by flexing the spring wire hanger 18 so that the ends 28 thereof enter the receptacles 26 formed by the dimples 22. While the dimples 22 shown in the embodiment of FIGS. 1 and 2 are formed in strips 24 which are fastened to the tray 10, it is also a feature of the invention that the dimples may be struck directly from the tray 10 whereby separate strips may be eliminated.

Figure 3:
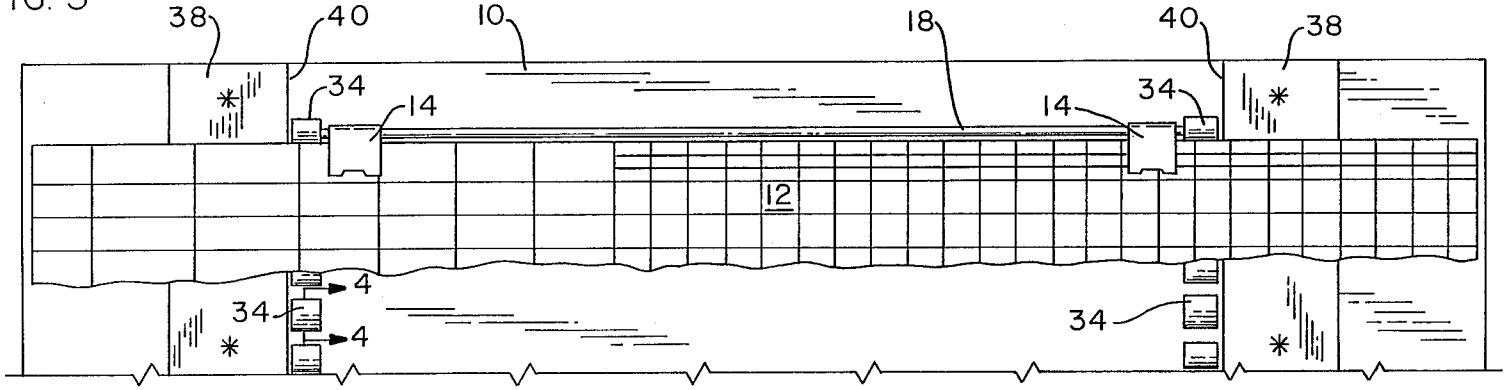
FIG. 3 is a plan view partially broken away showing a modified embodiment of a visible card index constructed according to the invention.

Referring to FIG. 3, there is shown another embodiment of the invention comprising a tray 10 carrying a card 12. The card 12 depends from a wire hanger 18 upon which are mounted conventional hinges 14 of the type described in connection with FIG. 1. According to this embodiment of the invention, the dimples shown in FIGS. 1 and 2 are replaced by two vertical rows of spaced generally parallel securing straps indicated generally at 34. As will be seen from FIG. 4, each securing strap 34 is struck from the tray 10 to form a bight 36 to receive the end 28 of the wire hanger 18.

A pair of spaced generally parallel elongated strips 38 are attached to the panel 10 with the inner edges 40 of the strips adjacent the outer edges of the straps 34. The strips 40 may be attached to the tray 10 in any suitable manner such as by spot welding or the like. The inner edges 40 of the strips 38 provide abutments for the ends 28 of the wire hangers 18 to limit and prevent lateral movement thereof.

Figure 5:
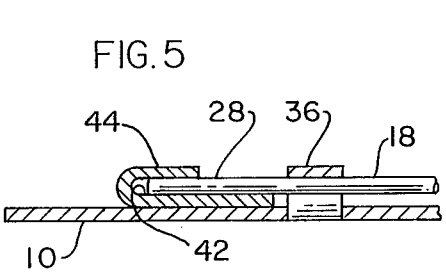
FIG. 5 is a partial vertical section through another embodiment of mounting means for a wire hanger in a visible index system according to the invention.

Referring to FIG. 5, there is shown still another embodiment of the invention wherein the abutment strips 38 shown in FIG. 3 may be replaced by channels 42 having reverse bent outer edges terminating in flanges 44 which receive the ends 28 of the wire hangers 18. This embodiment of the invention has the advantage of disposing the wire hanger 18 in a spaced relationship to the tray 10 to provide a freer movement of the hinges 14.

Figure 4:
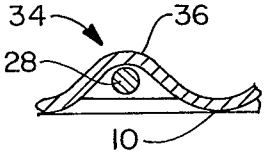
FIG. 4 is a partial vertical section taken along the line 4—4 of FIG. 3 showing details of the fastening strap for the wire hanger.
Figure 10:
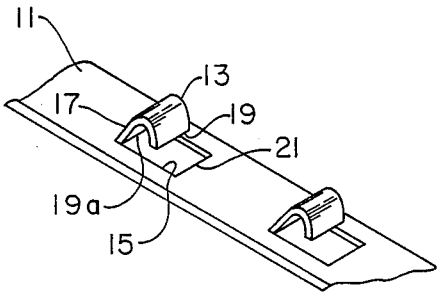
FIG. 10 is a partial perspective view showing another embodiment of hanger securing strap.

Referring to FIG. 10, there is shown a further embodiment of strap which may replace the straps 34 shown in FIGS. 3 and 4. Thus, in FIG. 10, there is seen a metal strip 11 having inverted J-shaped straps 13 struck therefrom to leave slots or openings 15 in the strip 11. The upper end 17 of the strap 13 is attached to the upper edge 19*a* of the slot 15 whereas the lower or free edge 19 of the strap is spaced from the lower slot edge 21. This type of strap having a free end or edge may be utilized where the nature of the metal of which the panel, tray or strip is formed is not readily susceptible of the workability required to form a continuous strap of the type shown at 34 in FIG. 4. The free or lower edge 19 of the strap 13 in FIG. 10 may be bent so as to be adjacent the plane of the upper surface of the strip 11 to provide substantially complete peripheral containment of the hanger. The arrangement illustrated in FIG. 10 using the inverted "J" strap shape and slot permits the provision of straps of a relatively large diameter while still providing substantially complete containment of the hanger. While the strap 13 shown in FIG. 10 is referred to as an inverted "J" strap, it will be appreciated that from, an edge view, it gives virtually a "U" shaped appearance. The elongated strip 11 may be fastened to the tray by spot welding, riveting or other suitable techique. While the strap is described as metal, it will be apparent that other materials such as synthetic resins may also be utilized for either or both the strip and the tray. The strip 11 may be mounted adjacent to end or edge strips such as strips 38 in FIG. 3 to provide lateral securement of the hanger ends.

Figure 12:
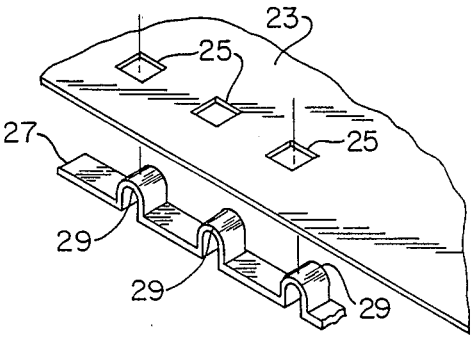
FIG. 12 is an exploded perspective view showing a portion of a tray or panel and a portion of a strap shaped to form a still additional embodiment of hanger securing device.
Figure 13:
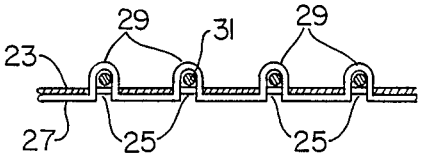
FIG. 13 is a vertical section showing the hanger securing device of FIG. 12 is an assembled position of hanger wires extending therethrough.

Referring to FIGS. 12 and 13, there is shown still another embodiment for forming straps of the same general type as the strap 34 illustrated in FIG. 4. Referring to FIGS. 12 and 13, the tray 23 may be provided with a series of generally rectangular openings 25 disposed at positioned where it is desired to support the hangers. Parallel rows of openings 25 may be provided at two or more spaced positions on the tray extending along lines disposed vertically to the desired hanger axes. Associated with each row of openings 25 is an elongated metal strip 27 having a width slightly smaller than the lateral width of the openings 25. A series of U-shaped bights 29 are struck in the strip 27 at spacings corresponding to the spacings of the openings 25. The bights 29 are dimensioned and positioned to extend through the openings 25 as illustrated in FIG. 13. In this assembled form, the bights 29 form straps to support wire hangers 31. The strip 27 may be secured to the tray 23 in any suitable manner such as spot welding, riveting or the like. Again, the strap and tray provide substantially complete peripheral containment of the hanger. The strips 27 may be mounted adjacent lateral containment strips of the type illustrated at 38 in FIG. 3 or may be associated with channels of the type illustrated at 42 in FIG. 5. As a still further alternative, the strips 27 may have struck therefrom quadrispherical dimples such as shown in FIGS. 1 and 2; and these may extend through the openings 25.

Figure 11:
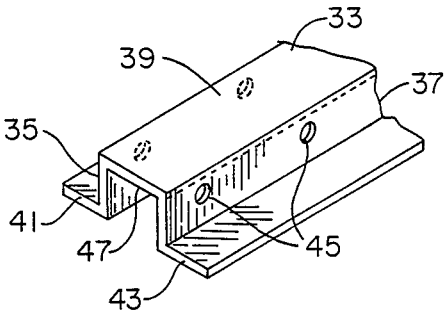
FIG. 11 is a partial perspective view showing a still further embodiment of hanger securing device.

Still another embodiment of means for securing the hangers is illustrated in FIG. 11. According to this embodiment of the invention, an elongated generally U-shaped channel member 33 is provided with spaced generally parallel side walls 35 and 37 joined by a top wall 39. The side walls 35 and 37 are formed with outwardly extending flanges 41 and 43. Spaced apertures 45 are provided in the side walls 35 and 37 immediately adjacent the under surface 47 of the top wall 39. Apertures 45 are adapted to receive wire hangers. The placement of the apertures 45 immediately adjacent the under surface 47 of the top wall 39 minimizes the height of the securing means above the hangers. The channel members 33 may be mounted on a suitable panel or tray by any suitable means such as spot welding, riveting, or the like as a substitute for the hanger mounting means illustrated in FIGS. 3, 4, 5, 10, 12, and 13, by the way of example. If desired, the apertures 45 in the outermost side walls 35 of the channel members 33 may be eliminated so that the channel members 33 may serve not only to peripherally contain the hangers but also as a lateral abutment.

Figure 6:
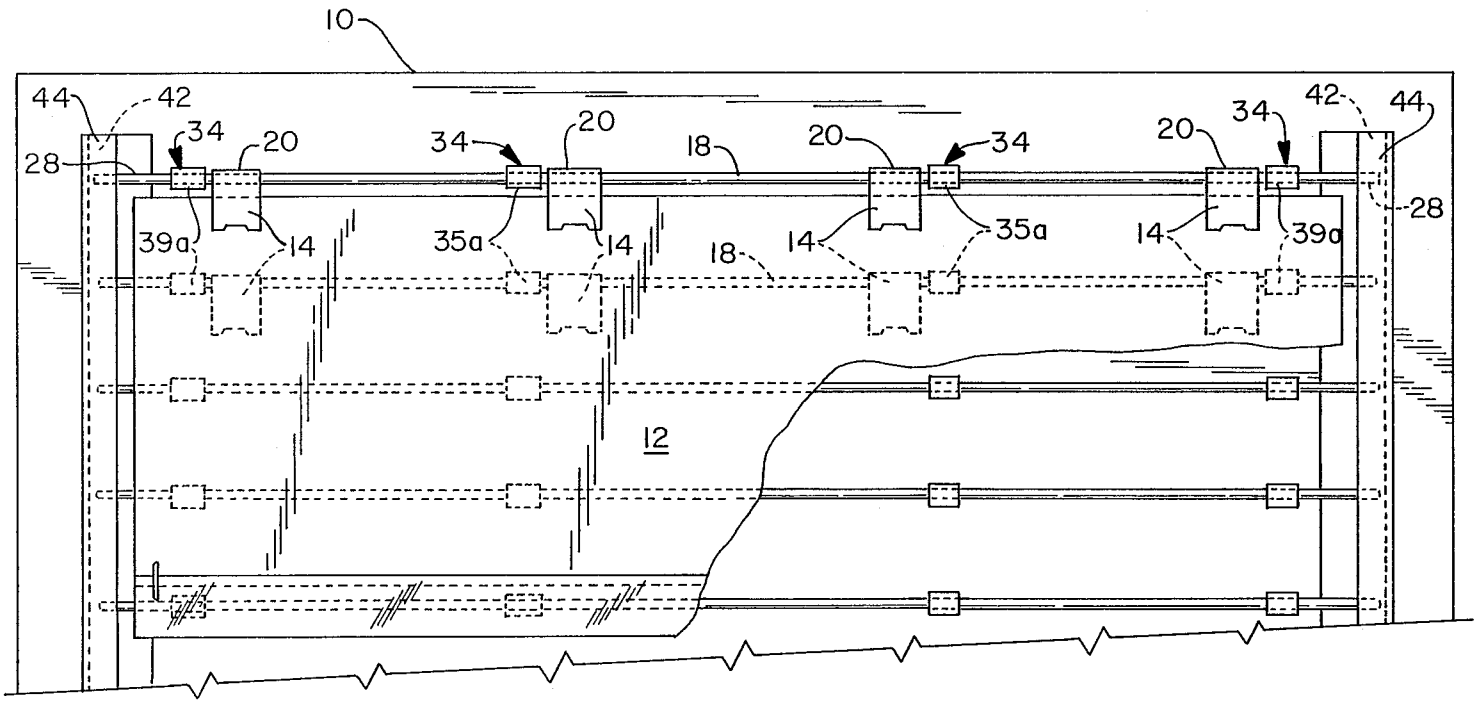
FIG. 6 is a partial plan view of a preferred embodiment of a large visible index system constructed according to the invention.

Referring to FIG. 6, there is seen another preferred embodiment of the invention which is particularly adapted for use in large size index display systems. According to this embodiment of the invention, a tray 10 has mounted thereon a series of cards 12. The cards 12 are carried by hinges 14 of the type described in connection with FIG. 1. It will be seen that according to this embodiment of the invention four hinges 14 are provided at spaced intervals along the top edge of the large card 12. Hinges 14 receive in their barrels 20 a relatively long resilient wire hanger 18. The ends of the hanger 18 are received beneath flanges 44 carried by channels 42 in the manner described in detail in connection with FIG. 5. Intermediate the ends 28 of the wire hangers 18 and preferably adjacent the hinges 14 are two vertical rows of spaced straps indicated generally at 34.

Figure 7:
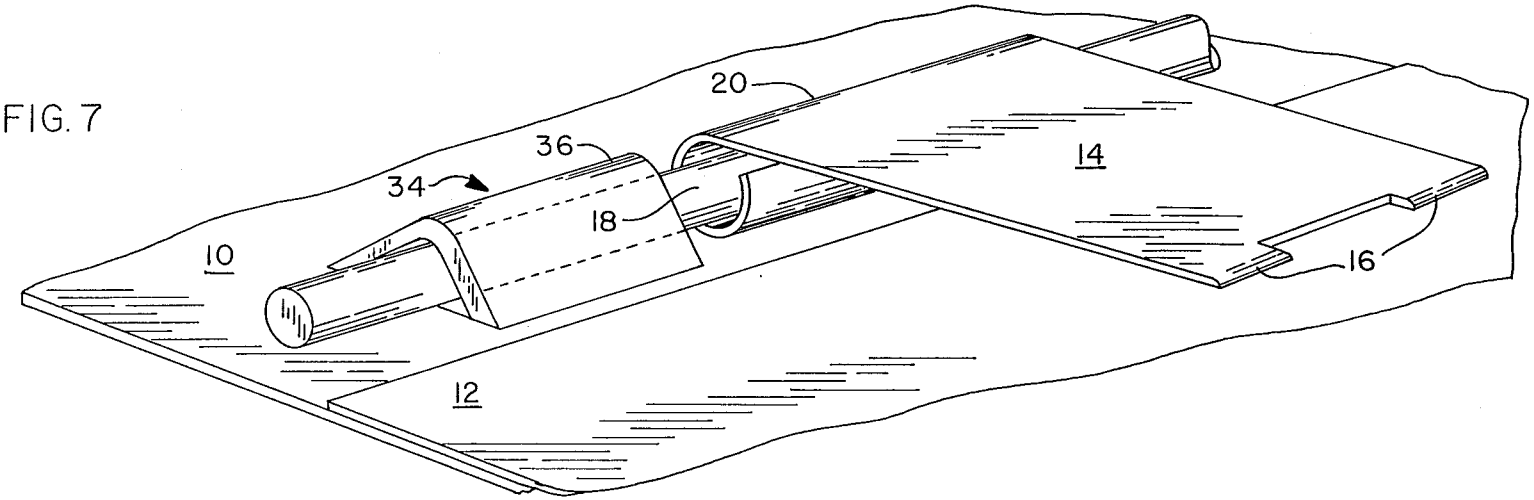
FIG. 7 is a perspective view showing details of the mounting straps, hanger and hinge of the visible card index system of FIG. 6.

The straps 34 illustrated in FIG. 6 are illustrated in detail in FIGS. 4 and 7 and comprise bights 36 struck from the tray 10. FIG. 7 shows the strap 34 having the edge of its bight 36 adjacent the edge of the barrel 20 of the hinge 14 attached by lugs 16 to card 12. The adjacent arrangement of the straps 34 and hinges 14 limits and prevents lateral movement of the card with respect to the tray. This provision of lateral restraint intermediate the ends of the hanger enhances the integrity, strength and durability of the visible index system.

As will be seen from FIG. 6, the innermost hinges 14 are mounted inwardly of the inner rows 35a of adjacent straps 34. The outermost hinges 14 are mounted inwardly of the outermost roes 39*a* of straps 34. With this arrangement, the two left hinges 14 prevent leftward lateral movement of the card 12 with respect to the tray 10 as seen in FIG. 6 while the two right hinges 14 prevent rightward movement of the card 12 with respect to the tray 10. The card 12 may be readily removed by flexure of the wire hanger 18 to permit an end 28 to spring free of its restraining flange 44. Once an end is thus freed, the hanger may be axially withdrawn from the straps and hinges to permit removal of the card.

The embodiment of the invention illustrated in FIG. 6 is particularly adapted to a variety of sizes of large cards and trays. The provision of the multiple spaced rows of straps 34 provides rigidity of mounting for the hanger and prevents inadvertent flexure of the hanger resulting in undesired detachment of the card from the tray. While four rows of hinges and straps are illustrated, additional rows may be provided where desired.

Figure 14:
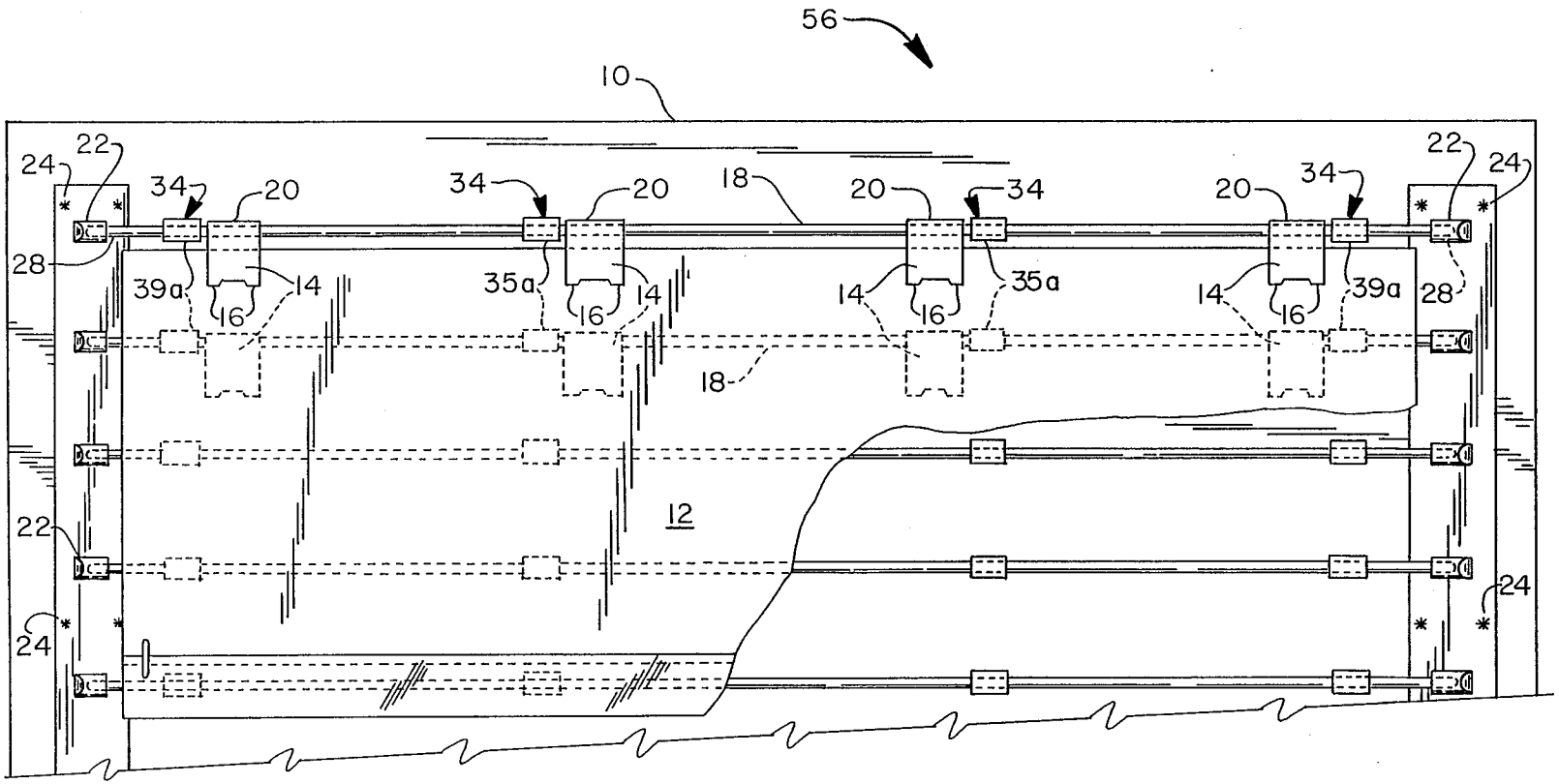
FIG. 14 is a view similar to FIGS. 1 and 6 of an embodiment of the invention which incorporates features from both the FIG. 1 and FIG. 6 embodiments of the invention.

It will be appreciated that the flanges 44 illustrated in FIG. 6 may be replaced with the dimples illustrated in FIGS. 1 and 2 as an alternate means of securing the ends of the wire hangers (a visible index system of this character is illustrated in FIG. 14 and identified by reference character 56). Such dimples may be provided either in separate parallel metal strips of the type illustrated in FIGS. 1 and 2 or may be struck directly from the tray as descriged in connection with the embodiment of the invention illustrated in FIGS. 1 and 2. Similarly, the straps 34 in FIG. 7 may be replaced with securing means such as the straps illustrated in FIGS. 10, 12 and 13 or securing means in the shape of U-shaped channels such as illustrated in FIG. 11.

A visible index system contructed according to this embodiment of the invention permits the convenient compiling, preserving, and presentation of a high volume of data or information. The system is efficiently usable in a large format which is easily assembled and at the same time provides a structural integrity not readily attainable with conventional systems using a very large number of hangers and cards or pocket cards. The construction lends itself to variations in size and configuration without sacrifice of record visibility, integrity or security.

Figure 8:
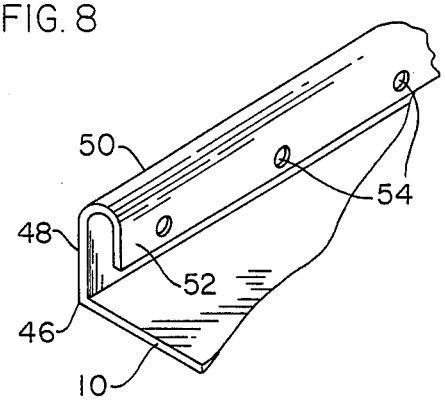
FIG. 8 is a partial perspective view showing still another embodiment of securement or mounting for a wire hanger for the ends of a visible index system constructed according to the invention.
Figure 9:
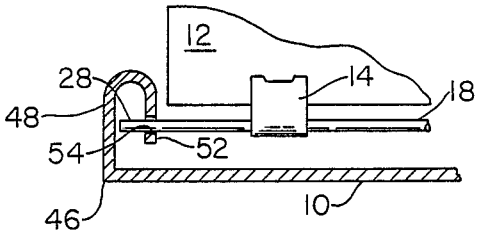
FIG. 9 is a vertical section through the embodiment of FIG. 8 showing the relationship of the card, hinge and wire hanger to the mounting means.

Referring to FIGS. 8 and 9, there is shown still another embodiment of end mounting for wire hangers arranged according to the invention. In FIGS. 8 and 9, the tray 10 is provided at its side edges 46 with upstanding flanges 48. The upstanding flanges 48 have their upper ends bent in a reverse U-shaped fashion to form bights 50 and downwardly extending walls 52. The walls 52 are provided with spaced apertures 54 to receive the ends 28 of wire hangers 18. Cards 12 are fastened to the wire hangers 18 by means of hinges 14 as described in detail in connection with FIG. 1 and 2 and as illustrated in detail in FIG. 7. Such cards or card holders are supported according to the invention as shown in FIG. 6 which illustrates the intermediate mounting straps 34.

It will be apparent from the foregoing that the improved visible card index system of the invention provides an effective and economical system for recording, preserving, and presenting a large volume of information while eliminating the need for potentially hundreds of wire hangers. The new system entails the use of large cards or pocket cards hingedly mounted on large panel means or frames through the use of both end and intermediate mounting means disposed to adequately support relatively long hangers and limit lateral movement of both the cards or pocket cards as well as the hangers. The mounting means provide for substantially complete peripheral containment of the hangers. The hangers may be mounted on the panel means or frame by flexure of the hangers to permit axial entry into the various mounting means. The system is particularly well adapted for use with metal panel and mounting means wherein the individual mounting devices may be simply struck from the metal in a highly economical fashion. Because of the significant reduction in the number of cards or pocket cards and associated wire hangers, the manufacture of the device is simplified and reduced in cost.

The invention may be embodied in many specific forms without departing from the spirit or essential characteristics thereof. The present embodiments are therefore to be considered in all respects as illustrative and not restrictive. The scope of the invention is indicated by the appended claims rather than by the foregoing description, and all changes which come within the meaning and range of equivalency of the claims are therefore intended to be embraced therein.

What is claimed as our invention is:

1. A visible card index system for hingedly mounting a plurality of card means on panel means using a multiplicity of resilient wire hanger means disposed in spaced parallel relationship with at least the ends thereof attached to said panel meays by mounting means disposed in a direction substantially perpendicular to the axis of said parallel hanger means, at least a pair of hinge means attached to an edge of a card means for restraining said card means against lateral movement relative to said panel, a resilient wire hanger means extending through said hinge means with spaced end sections extending beyond said hinge means, said mounting means including spaced portions receiving at least portions of said end sections of said hanger means, said portions of said mounting means being configured to substantially peripherally surround said portions of said end sections received therein and said hinge means abutting an edge of said mounting means whereby said hanger means may be axially inserted into said portions of said mounting means to removably mount said card means on said panel means.

2. A visible card index system according to claim 1 wherein said mounting means receiving said portions of said end sections of said hanger means comprises generally semicylindrically shaped receptacles with closed outer ends.

3. A visible index system which comprises: a card means, a card means support, and a hanger wire for detachably fixing said card means to said card means support, said card means including a sheetlike main body portion and hinges affixed to said main body portion at at least the opposite ends of, and along, one edge thereof, said hanger wire extending through said hinges, said card means support having cooperating retaining means at the opposite edges thereof in which the ends of the hanger wire are installed to so detachably fix said card means to said support that said card means can pivot relative to the support, and said visible index system further comprising means so engageable by at least two of the card means hinges as to limit lateral movement of said card means relative to said support.

4. A visible index system as defined in claim 3 which also has at least two hanger wire retaining means between whose at the ends of the card means for also detachably affixing said card means to said card means support and wherein it is the intermediate hanger wire retaining means that are abutted by said card means hinges to limit lateral movement of said card means relative to the card means support.

5. A visible index system as defined in claim 3 wherein said card means support has a sheetlike main body portion, wherein said card means support has at least one intermediate hanger wire retaining means located between those hanger wire retaining means at the edges of the card means support, wherein the intermediate retaining means is formed in the main body portion of the card means support, and wherein it is said intermediate retaining means that are engageable by said and card means hinges to limit movement of said card means relative to said support.

6. A visible index support as defined in claim 4 wherein said card means support has a sheetlike main body portion and intermediate hanger wire retaining means located between those retaining means at the edges of the card means support, wherein the intermediate retaining means are formed in the main body portion of the support, wherein it is said intermediate retaining means that are engageable by said card means hinges to limit lateral movement of said card means relative to said support, wherein there are elongated members fixed to said main body portion of the card means support at the opposite edges thereof, and wherein those hanger wire retaining means at the opposite edges of the card means support are defined by said elongated members.

7. A visible index system which comprises: a card means, a card means support, and a hanger wire for detachably fixing said card means to said card means support, said card means including a sheetlike main body portion and hinges affixed to said main body portion at at least the opposite ends of, and along, one edge thereof, said hanger wire extending through said hinges, said card means support having cooperating retaining means at the opposite edges thereof in which the ends of the hanger wire are installed to so detachably fix said card means to said support that said card means can pivot relative to the support, and said visible index system further comprising means intermediate said retaining means and engageable by at least two of the card means hinges to limit lateral movement of said card means relative to said support.

8. A visible index system as defined in claim 3 or in claim 7 wherein said hanger wire is sufficiently flexible that it can be bent to the extent necessary to install it in the card means support without exceeding the elastic limit of the material from which the hanger wire is fabricated.

9. A visible index system as defined in claim 3 or in claim 8 in which the card means hinges are located inwardly of the hanger wire retaining means with which they cooperate to limit lateral movement of the card means.

10. A visible index system as defined in claim 3 or in claim 7 in which there is an independent set of hanger wire retaining means as aforesaid spaced at intervals along the length of said card means support and wherein there are card means affixed to said support by hanger wires as aforesaid and at least selected ones of said sets of hanger wire retaining means.

11. A visible index system as defined in claim 3 or in claim 7 which has multiple sets of hanger wire retaining means as aforesaid for independently fixing an equal number of card means to said card means support as aforesaid.

12. A visible index system as defined in any of the preceding claims 4–8 which also includes means for limiting lateral movement of said hanger wire relative to said card means support.

13. A visible index system as defined in claim 12 wherein the means for limiting lateral movement of the hanger wire is comprised by an integral, hanger wire engageable abutment at the outer end of each hanger wire retaining means.

14. A method of assembling a visible index system which includes: (a) a card means having hinges at opposite ends of one edge thereof, a card means support having first and second laterally aligned hanger wire receiving means at the opposite edges thereof, and at least one intermediate hinge retaining means aligned therewith, and (b) an elongated hanger wire, said method comprising the steps of: locating said card means on the card means supporting side of said support, sliding one end of said hanger wire seriatim through one of said card means hinges, the intermediate hanger wire retaining means, and the other of said card means hinges and into engagement with the first of the hanger wire retaining means, flexing said hanger wire until the opposite end of the hanger wire clears the second of the hanger wire retaining means, and then engaging said opposite end of said hanger wire with said second hanger wire retaining means.

15. A visible index system as defined in claim 3 or in claim 8 wherein the retaining means at the opposite ends of the card means support in part underlie and support said hanger wire in spaced relationship to said card means support to provide free rotation of said card means relative to said support.

16. A visible index system as defined in claim 3 or in claim 7 wherein the distance between the cooperating retaining means at the opposite edges of said card means support is less than the width of said card means, whereby said hinges may be attached to said card means at locations well removed from the edges of the card means to provide optimal support of said card means from the card means support.

* * * * *